US005121546A

United States Patent [19]

Chong

[11] Patent Number: 5,121,546

[45] Date of Patent: Jun. 16, 1992

[54] CAN OPENER

[76] Inventor: Wun C. Chong, 69 Wallace Place, Delta, British Columbia, V4M 3S2, Canada

[21] Appl. No.: 605,194

[22] Filed: Oct. 29, 1990

[51] Int. Cl.[5] ..... B67B 7/32; B67B 7/20; B67B 7/00

[52] U.S. Cl. ..... 30/418; 30/417; 30/416

[58] Field of Search ..... 30/413, 415, 416, 417, 30/418, 420

[56] References Cited

U.S. PATENT DOCUMENTS

| | | | |
|---|---|---|---|
| 1,935,680 | 11/1933 | von Wolforsdorf | 30/417 |
| 3,881,247 | 5/1975 | Niwa | 30/417 |
| 4,782,594 | 11/1988 | Porucznik et al. | 30/417 |
| 4,833,783 | 5/1989 | Davel | 30/417 |

FOREIGN PATENT DOCUMENTS

| | | | |
|---|---|---|---|
| 994538 | 8/1976 | Canada | 30/419 |

*Primary Examiner*—Douglas D. Watts
*Assistant Examiner*—Paul M. Heyrana, Sr.

[57] ABSTRACT

A can opener comprising a housing having a handle. There is a cutting wheel with a cutting edge for severing a can wall, the cutting wheel defining a cutting wheel axis. There is a traction wheel having a gripping surface to engage a can, the traction wheel defining a traction wheel axis. A pair of spindles rotatably mount the traction wheel and the cutting wheel in the housing such that their axes are substantially perpendicular and the wheels are positioned adjacent and spaced apart from each other to define a gap adapted to accept a can to be opened. One of the wheels is movable toward the other to close the gap thereby engaging and locking the can between the cutting wheel and the traction wheel such that the cutting wheel acts to sever the can wall and the traction wheel acts to move the can past the cutting wheel. In order to close the gap, a fixed thrust surface associated with the housing, and a spaced, adjacent movable thrust surface associated with the movable wheel are provided. A pivoting lever is introducible between the thrust surfaces such that the movable thrust surface is moved away from the fixed thrust surface to displace the movable wheel with respect to the other wheel. A transverse handle is associated with one of the wheels to effect rotation thereof.

16 Claims, 1 Drawing Sheet

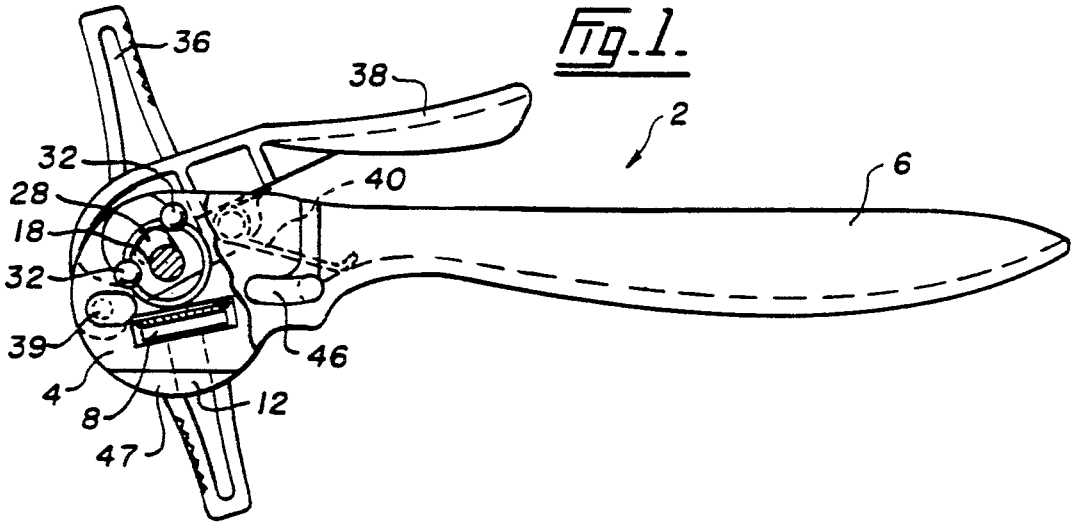
Fig. 1.
Fig. 2.
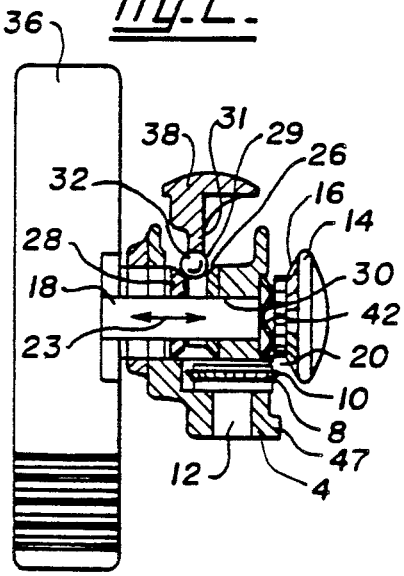
Fig. 3.
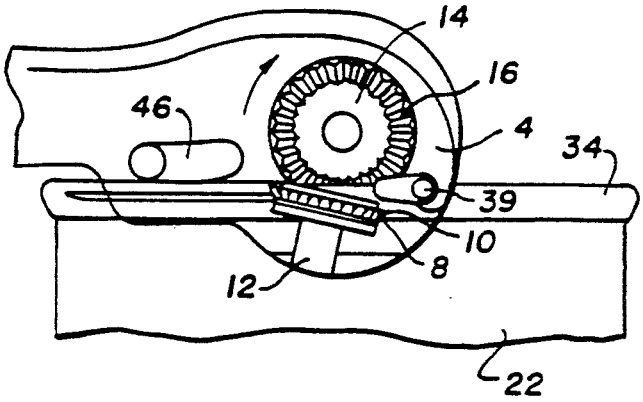
Fig. 4.
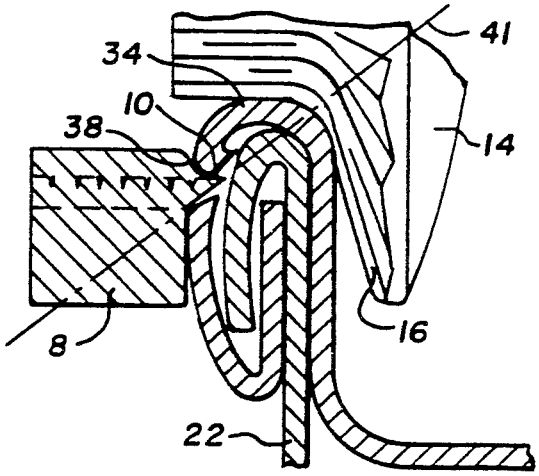
Fig. 5.
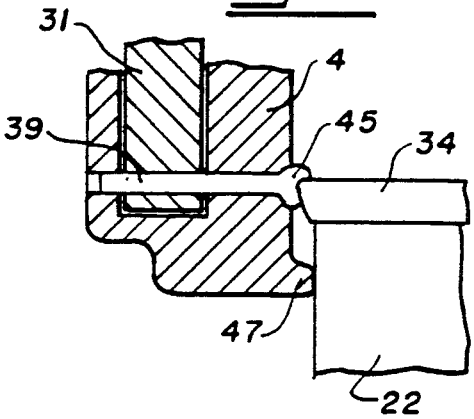

CAN OPENER

FIELD OF THE INVENTION

This invention relates to a can opener for opening cans, and is particularly directed to a can opener that cuts the outer seam wall of a can.

BACKGROUND OF THE INVENTION

Can openers for quick and efficient opening of conventional tin can containers are well known. Can openers in use today are generally of the type that cut the top end of the can to gain access to the can contents. The major problem associated with this method of opening is that the cutting blade tends to come into contact with the contents of the can. The cutting blade, if not particularly sharp, will tend to form small shavings that contaminate the contents of the can. In addition, if the entire circumference of the can top is cut, the can top tends to fall into the can contents which can be difficult and messy to remove from the can interior particularly when canned food is involved.

To address these problems, can openers have been developed that are designed to cut the outside seam wall at the top of the can. Examples of these openers include U.S. Pat. No. 3,719,991 to French, U.S. Reissue Pat. No. 27,504 to Smith, U.S. Pat. No. 1,935,680 to Von Wolforsdorf, U.S. Pat. No. 4,782,594 to Porucznik et al., and U.S. Pat. No. 3,510,941 to Fyfe. All these patents rely on a cam arrangement including a pin sliding in an arcuate slot for engaging and locking the can opener on the can to be opened. While these cam arrangements work adequately, over time there is a tendency for the moving parts to wear with the result that the engaging and locking function of the opener is impaired leading to difficulty in cutting the can and keeping the opener in position on the can.

SUMMARY OF THE INVENTION

Accordingly, there is a need for a can opener that employs a different system for engaging and locking the can opener on a can to be opened during a cutting operation. The present invention provides a can opener comprising:

a housing having a handle;

a cutting wheel having a cutting edge for severing a can wall, said cutting wheel defining a cutting wheel axis;

a traction wheel having a gripping surface to engage a can, said traction wheel defining a traction wheel axis;

means rotatably mounting said traction wheel and said cutting wheel in said housing such that their axes are substantially perpendicular and said wheels are positioned adjacent and spaced apart from each other to define a gap adapted to accept a can to be opened, one of said wheels being movable toward the other to engage and lock said can between said cutting wheel and said traction wheel such that said cutting wheel acts to sever said can wall and said traction wheel acts to move said can past said cutting wheel;

a fixed thrust surface associated with said housing, a spaced, adjacent movable thrust surface associated with said movable wheel, separating means introducible between said thrust surfaces such that said movable thrust surface is moved away from said fixed thrust surface to displace said movable wheel with respect to said other wheel; and means associated with one of said wheels to effect rotation thereof The separating means introducible between the thrust surfaces is preferably a plurality of ball bearings mounted in a pivotable finger-actuatable lever. The lever is positioned to fall under the thumb of a user's hand holding the handle of the opener for easy control and operation of the can opener of the present invention.

BRIEF DESCRIPTION OF THE DRAWINGS

Aspects of the present invention are illustrated, merely by way of example, in the accompanying drawings in which:

FIG. 1 is a side view of a can opener with broken away sections according to a preferred embodiment of the present invention;

FIG. 2 is a front view of the opener with broken away sections showing details of internal structure;

FIG. 3 shows the can opener in use on a can to be opened;

FIG. 4 is a detailed view showing the cutting wheel and traction wheel engaged on a can during the cutting operation; and FIG. 5 is a section view showing the guiding means of the opener of the present invention.

DESCRIPTION OF THE PREFERRED EMBODIMENTS

The Figures show a preferred embodiment of the can opener of the present invention. Referring to FIGS. 1 and 2, the can opener 2 comprises a housing 4 having a handle 6. Within housing 4, there is a cutting wheel 8 having a cutting edge 10 for severing a can wall. The cutting wheel is mounted on a rotatable spindle 12 that defines a cutting wheel axis. Housing 4 also contains a traction wheel 14 having a gripping surface 16 to engage a can to be opened. Gripping surface 16 is preferably ridged in a regular pattern to improve gripping engagement with a can to be opened. Traction wheel 14 is mounted on a second rotatable spindle 18 that defines a traction wheel axis. Cutting wheel 8 and traction wheel 14 are mounted in housing 4 such that their axes are substantially perpendicular and the wheels are positioned adjacent and spaced apart from each other to define a gap 20 adapted to accept a can to be opened.

One of the wheels is movable toward the other to close gap 20 thereby engaging and locking a can 22 to be opened between the cutting wheel and the traction wheel. When a can is so engaged, as best shown in FIG. 3, cutting wheel 8 acts to sever the can wall and traction wheel 14 acts to move the can past the cutting wheel.

In the illustrated embodiment, traction wheel 14 is the wheel that is movable toward cutting wheel 8. This movement is possible due to traction wheel spindle 18 being mounted within housing 4 for axial movement therein, as indicated by arrow 23.

The movement of traction wheel 14 along the traction wheel spindle axis is accomplished using a series of thrust surfaces that can be separated or drawn together. Fixed thrust surface 26 is mounted to housing 4 so that it remains stationary with respect to the housing at all times. A spaced, adjacent movable thrust surface 28 is associated with the axially movable traction wheel, and the two thrust surfaces define a central channel 29. Traction wheel spindle 18 slidably passes through fixed thrust surface 26 and has movable thrust surface 28 rigidly affixed thereto so that the any axial movement of thrust surface 28 is transmitted to the spindle and the traction wheel. As best shown in FIG. 2, housing 4 is formed with a bearing aperture 30 therethrough to rotatably accept spindle 18. Thrust surfaces 26 and 28 are preferably in the form of disc springs.

Separating means introducible between the thrust surfaces are provided in the form of two or more ball bearings 32. Ball bearings 32 are dimensioned so as to cause movable thrust surface 28 to move away from fixed thrust surface 26 when introduced into channel 29 between the thrust surfaces. This results in axial displacement of movable traction wheel 14 toward cutting wheel 8. This motion closes gap 20 and initiates the cutting operation of the can opener by squeezing the can between the traction wheel and the cutting wheel.

Ball bearing 32 is introducible between thrust surfaces 26 and 28 by way of a finger-actuatable lever 38 pivotally attached to housing 4 at hinge 39. Lever 38 rotatably houses two or more ball bearing 32 and is depressible downwardly between the thrust surfaces. Lever 38 is formed with a semi-circular narrowed throat section 31 adapted for movement into and out of channel 29. Throat section 31 rotatably houses ball bearings 32. Preferably, the ball bearings are retained in a conventional retaining clip arrangement formed in the lever. In normal operation, the can opener would be grasped by handle 6 and the user's thumb conveniently falls to lever 38 to control cutting engagement of the opener with a can 22. As best shown in FIG. 1, lever 38 is biased upwardly by spring 40 such that the can opener has gap 20 open ready to engage a can until lever 38 is depressed. In addition, lever 38 is formed with an arcuate slot through which spindle 18 passes. The lower slot wall engaging with the underside of spindle 18 acts to limit the upward travel of lever 38. A spring washer 42 is interposed between traction wheel 14 and housing 4 to ensure that traction wheel spindle 18 is displaced outwardly of the housing to ensure that gap 20 remains open when lever 38 is not depressed.

In FIG. 1, note that handle 6 is formed with a U-shaped cross section into which lever 38 moves when fully depressed.

The illustrated can opener is intended to engage and cut the outer seam wall 34 of a conventional tin can 22 as shown in FIG. 4. Traction wheel 14 has a gripping surface 16 adapted to engage the top and inside edges of the seam wall while cutting edge 10 of cutting wheel 8 engages the outer side of the seam wall.

Means to effect rotation of the traction wheel are provided in the form of transverse handle 36 affixed to the end of traction wheel spindle 18. Handle 36 is rotated by the user to rotate the traction wheel thereby advancing the can past the cutting blade to extend the cut about the entire circumference of the can. In this regard, ball bearing 32 provides a bearing surface to allow thrust surface 28 affixed to traction wheel spindle 18 to rotate freely with respect to fixed traction surface 26 to ensure smooth and easy rotation of the traction wheel.

Note in FIG. 3 that the cutting wheel spindle 12 is preferably mounted at a small angle to the vertical as this has been found to improve the engagement of the cutting wheel with the can seam wall to ensure a neat cut. A desirable angle is 12.5 degrees from the vertical.

Referring to FIG. 4, it is also preferable that cutting wheel 8 be formed with a raised lip 38 behind cutting edge 10 which acts to fold under the cut edge of the can top to eliminate any sharp edges. Raised lip 38 has a periphery having an essentially concave cross-sectional configuration designed to ensure that the cut edge of the can top is neatly folded under. In FIG. 4, note force line 41 for the cutting edge 10 of the cutting wheel. This force line, representing the line along which the pressure exerted by the cutting edge is applied, intersects traction wheel 14 to ensure that slippage of the traction wheel does not occur.

As illustrated in FIGS. 3 and 5, abutment means are provided for guiding the movement of the can opener of the present invention about the can during a cutting operation. A first abutment member comprises a shoulder 45 adapted to sit abut the top and outside seam wall edges in front of the cutting and traction wheels. Preferably shoulder 45 is an extension of hinge 39 used to attach lever 38. Behind the cutting and traction wheel a flange 46 is provided to engage the top surface of a can seam wall. In order to stabilize the movement of the can opener in a vertical plan, a third abutment member can also be provided in the form of an extension 47 of housing 4 adapted to abut the side wall of a can to be opened.

Although the present invention has been described in some detail by way of example for purposes of clarity and understanding, it will be apparent that certain changes and modifications may be practised within the scope of the appended claims.

I claim:

1. A can opener comprising:

a housing having a handle;

a cutting wheel having a cutting edge for severing a can wall, said cutting wheel defining a cutting wheel axis;

a traction wheel having a gripping surface to engage a can, said traction wheel defining a traction wheel axis;

means rotatably mounting said traction wheel and said cutting wheel in said housing such that their axes are substantially perpendicular and said wheels are positioned adjacent and spaced apart from each other to define a gap adapted to accept a can to be opened, one of said wheels being movable toward the other to engage and lock said can between said cutting wheel and said traction wheel such that said cutting wheel acts to sever said can wall and said traction wheel acts to move said can past said cutting wheel;

a fixed thrust surface associated with said housing, a spaced, adjacent movable thrust surface associated with said movable wheel, separating means introducible between said thrust surfaces mounted to a lever pivotally attached to said housing the movable between a default position in which said lever is biased away from said housing and a second position in which said lever is depressed between said thrust surfaces to introduce said separating means between said thrust surfaces such that said movable thrust surface is moved away from said fixed thrust surface to displace said movable wheel with respect to said other wheel; and means associated with one of said wheels to effect rotation thereof.

2. A can opener as claimed in claim 1 in which said separating means is a ball bearing that allows said thrust surfaces to rotate with respect to each other when said ball bearing is interposed therebetween.

3. A can opener as claimed in claim 1 in which said means rotatably mounting said cutting and traction wheels are a pair of spindles rotatably mounted in said housing.

4. A can opener as claimed in claim 3 in which said movable wheel is said traction wheel by virtue of said traction wheel spindle being axially movable within said housing.

5. A can opener as claimed in claim 3 in which said means to effect rotation of one of said wheels is a handle transversely mounted to one of said spindles.

6. A can opener as claimed in claim 5 in which said handle is mounted to the spindle supporting said traction wheel.

7. A can opener as claimed in claim 1 in which said movable wheel is said traction wheel.

8. A can opener as claimed in claim 1 in which said cutting wheel is adapted for engaging the one side of the seam wall of a can and the traction wheel is adapted for engaging the other side of the seam wall.

9. A can opener as claimed in claim 8 in which said cutting wheel engages the outer side of a seam wall.

10. A can opener as claimed in claim 1 in which said thrust surfaces comprise disc springs.

11. A can opener as claimed in claim 1 including can abutment means for guiding the movement of said can opener about the can during the cutting operation.

12. A can opener as claimed in claim 11 in which said abutment means includes an abutment member adapted to engage with the top seam edge of a can and a further abutment member adapted for engagement with the side wall of said can.

13. A can opener as claimed in claim 1 in which said cutting wheel includes a circumferential cutting edge having a raised lip of generally concave cross-section set behind the cutting edge that acts to fold under the cut edge of a can.

14. A can opener as claimed in claim 1 in which said cutting member is positioned at an angle with respect to the vertical.

15. A can opener as claimed in claim 1 in which said moveable wheel is normally biased outwardly of the housing such that said gap is open for receiving a can to be opened.

16. A can opener as claimed in claim 15 in which said moveable wheel is biased outwardly by a spring washer.

* * * * *